United States Patent [19]

Schmidt

[11] Patent Number: 4,840,234

[45] Date of Patent: Jun. 20, 1989

[54] PNEUMATIC RAM BORING MACHINE

[76] Inventor: Paul Schmidt, Winterberger Strasse, 5940 Lennestadt 1, Fed. Rep. of Germany

[21] Appl. No.: 105,104

[22] Filed: Oct. 5, 1987

[30] Foreign Application Priority Data

Oct. 10, 1986 [DE] Fed. Rep. of Germany ..... 3634579

[51] Int. Cl.[4] ..... B25D 17/12

[52] U.S. Cl. ..... 173/90; 173/DIG. 2; 181/230

[58] Field of Search ..... 173/90, 91, DIG. 2; 175/19; 181/230, 252, 256, 258

[56] References Cited

U.S. PATENT DOCUMENTS

| | | | |
|---|---|---|---|
| 3,115,209 | 12/1963 | Bembinster | 181/256 X |
| 3,981,378 | 9/1976 | Potter | 173/DIG. 2 X |
| 4,144,941 | 3/1979 | Ritter | 173/125 X |
| 4,184,564 | 1/1980 | Trainor | 181/230 |

*Primary Examiner*—Frank T. Yost
*Assistant Examiner*—James L. Wolfe
*Attorney, Agent, or Firm*—Toren, McGeady & Associates

[57] ABSTRACT

A pneumatic ram boring machine (12) has an air-permeable hollow cylinder (2) with a sound absorbing and/or oil separating packing (9, 11) arranged in the exhaust air stream of the machine.

8 Claims, 2 Drawing Sheets

PNEUMATIC RAM BORING MACHINE

TECHNICAL FIELD OF THE INVENTION

The invention relates to a pneumatic ram boring machine in which an axially reciprocating piston imparts its impact energy to the housing and/or its impact tip.

BACKGROUND OF THE INVENTION AND PRIOR ART

Ram boring machines, also known as earth rockets, are mainly used to lay supply lines for water or electricity and telephone cables without having to tear up the road surface or the sidewalk. They usually have an impact tip acted on by a pneumatically operated impact piston. To drive the impact tip forwards the impact piston is reciprocated in a tubular housing by the action of compressed air supplied through a compressed air line alternately on the front and rear faces of the impact piston. Openings through the rear end of the housing allow the exhaust air to emerge into the tunnel made in the ground by the boring machine, and from there into the open air.

In the case of ram boring machines, as with most compressed air machines, lubricants, e.g. mineral oil or other additives are mixed with the compressed air. These additives emerge into the open air with the exhaust air as mist, and represent a danger to the operator and the environment.

The noise produced by most ram boring machines is often above the level of 90 dBA that in the long term is a danger to health. This level is mostly exceeded even in the case of a ram boring machine that operates predominantly below the surface of the earth. Particularly when a supply pipe is drawn in simultaneously with the ramming, a considerable amount of noise gets through to the exterior, since the pipe acts as a sounding pipe.

OBJECT OF THE INVENTION

The object of the invention is to provide a ram boring machine that reduces part of the adverse effects on the environment that accompany the operation of each compressed air machine.

SUMMARY OF THE INVENTION

According to the invention the object is achieved in the case of a ram boring machine of the above mentioned type by means of a hollow, air-permeable cylinder having a sound absorbing and/or oil separating packing, arranged in the exhaust air stream.

If the hollow cylinder has a central passage through it, it can be drawn over the compressed air line of the ram boring machine; it can also have a concentric pipe section, for example with projecting threaded ends to screw on to two sections of the compressed air line. The hollow cylinder then more or less fills the circular space between the compressed air line and the wall of the tunnel through the ground made by the ram boring machine, so that substantially all the exhaust air is treated.

The hollow cylinder can also have a cable connection on at least one end face, in order to stretch a rope between the rear end of the ram boring machine and the hollow cylinder, and/or the hollow cylinder and a pipe being pulled behind it.

The filter can be arranged either directly on the rear end of the ram boring machine or spaced from it in a supply pipe drawn behind the machine, since its external diameter matches the external diameter of the compressed air machine. Each of these arrangements ensures that practically no exhaust air gets through to the outside without having passed through the filter.

The hollow cylinder can have holes in its end faces that serve as passages for the exhaust air from the ram boring machine to pass through. If the inlet and outlet holes for the exhaust air are opposite one another, this ensures that the passage of air is unhindered except by the packing.

BRIEF DESCRIPTION OF THE DRAWINGS

The invention will now be explained in more detail with reference to an exemplary embodiment shown in the drawings, in which.

BRIEF DESCRIPTION OF AN EMBODIMENT OF THE INVENTION

Figure 2:
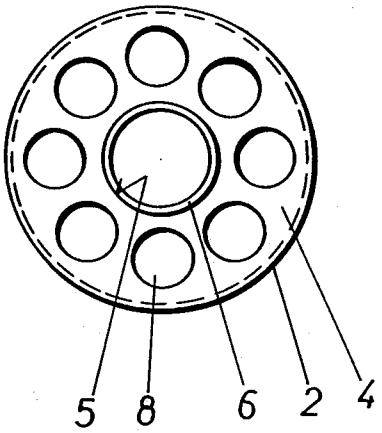
FIG. 2 shows a front view of the filter of FIG. 1.
Figure 1:
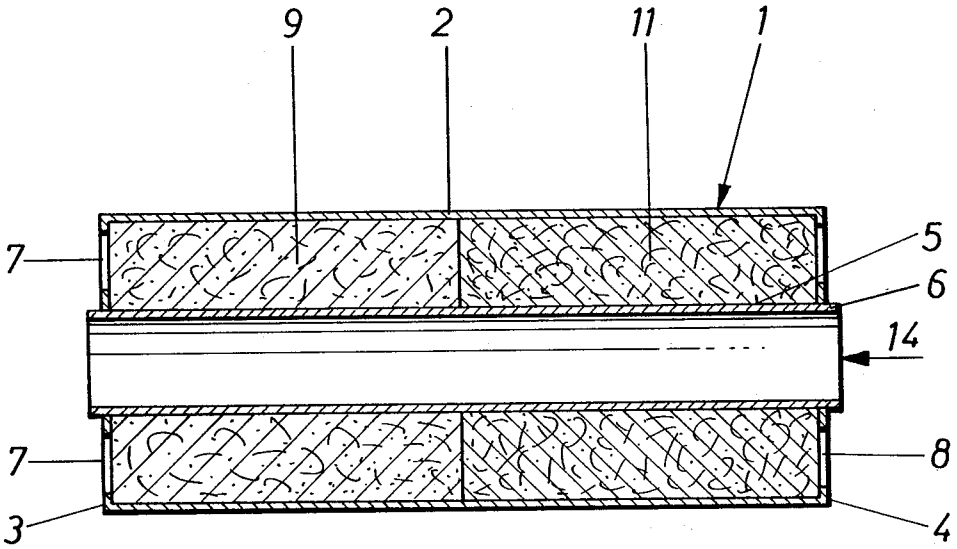
FIG. 1 shows a filter according to the invention in longitudinal section.

The filter 1 consists of a hollow cylinder 2 of which each of the end faces 3, 4 has a circular, central opening 5 for a section of pipe 6 of smaller diameter and slightly greater length, arranged concentrically to the cylinder 2, through which a compressed air line 10 can be drawn, and other holes 7, 8 arranged with their centres concentric to the opening 5. In the cylinder 2 there are filter materials 9, 11 for filtering and silencing the stream of exhaust air.

If the projecting parts of the pipe section have a hose coupling, for example a screw thread, the filter can also be arranged between two sections of the compressed air line 10: it then travels with the compressed air line as the machine moves forward.

The filter 1 is arranged in relation to a pneumatically operated ram boring machine 12 so that the compressed air reaches the ram boring machine in the direction of the arrow 14 and reciprocates an axially extending piston 18 for imparting impact energy to the housing of the boring machine. The exhaust air leaves the boring machine 12 and passes through the holes 7 in the end face 3 of the filter 1 into the sound absorbing packing 9 and then into the oil separating packing 11, and finally emerges through the holes 8 in the end face 5.

Figure 5:
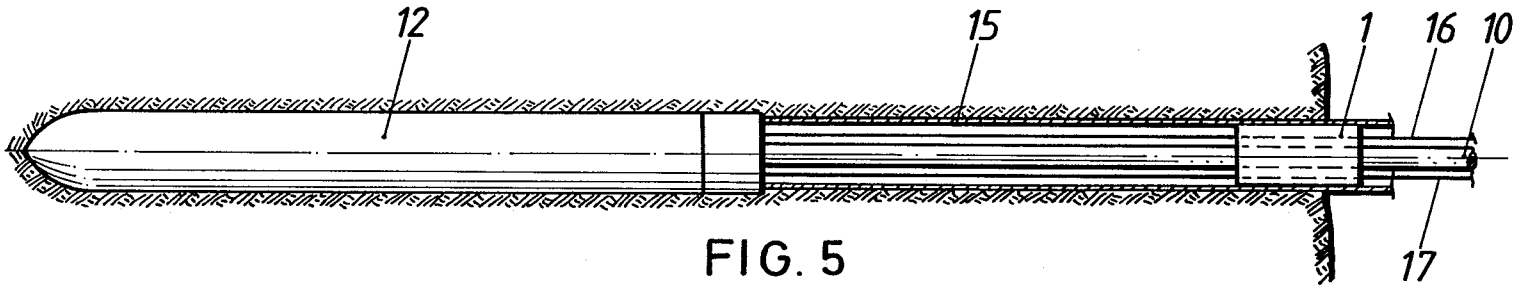
FIG. 5 shows a filter, according to FIG. 1, arranged in a pipe being pulled behind the machine.
Figure 4:
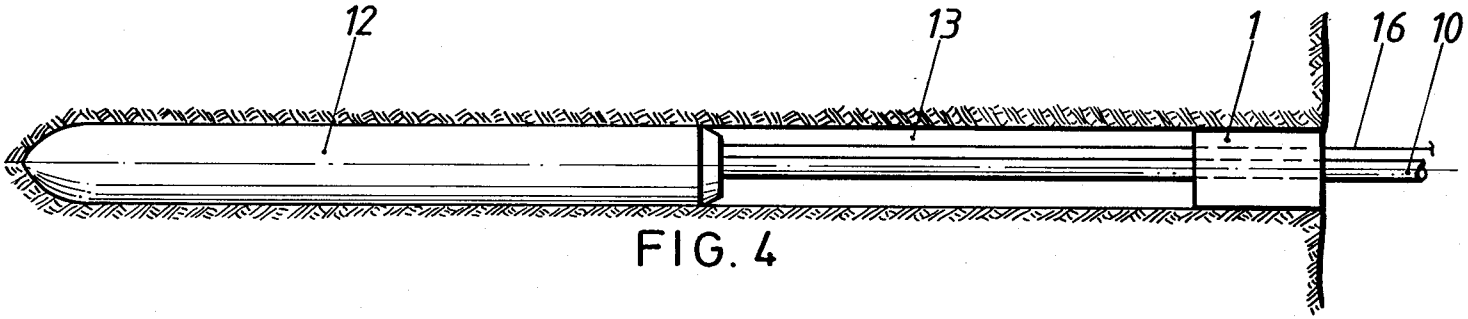
FIG. 4 shows a filter, as shown in FIG. 1, arranged in the entrance to a tunnel in the ground.
Figure 3:
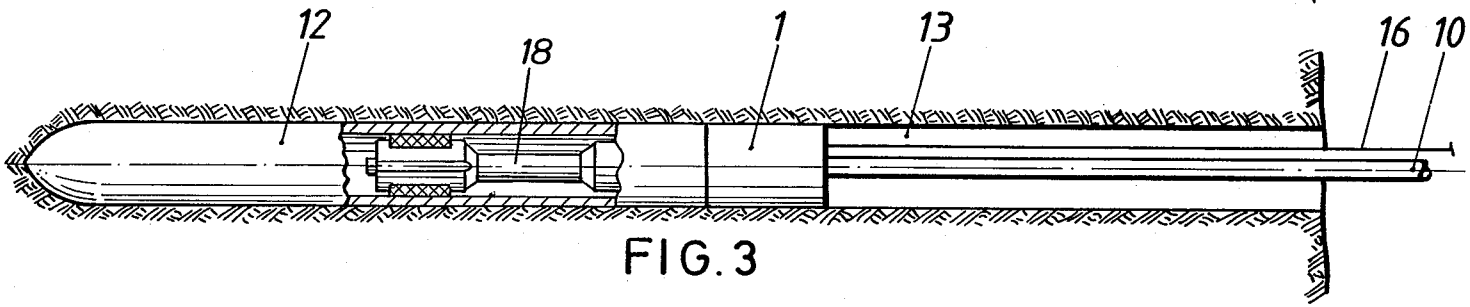
FIG. 3 shows a filter of FIG. 1 connected to a ram boring machine.

FIGS. 3 to 5 show various possible arrangements of the filter 1; it can be arranged directly at the rear end of the ram boring machine 12 (FIG. 3), or at the end of the tunnel 13 through the ground made by the ram boring machine 12 (FIG. 4), or in a lining tube 15 drawn behind the ram boring machine 12 (FIG. 5). If the ram boring machine 12 is provided with a control line and a tow rope 17, the hollow cylinder preferably has a corresponding passage (not shown) through it parallel to its axis. Alternatively, the tow rope can be fastened directly to the hollow cylinder.

Its external diameter corresponds to that of the ram boring machine or of the lining tube, so that practically no exhaust air can escape unfiltered.

It has been found that with ram boring machines the filter according to the invention reduces the sound level of the exhaust air substantially below 100 dBA, and removes a large percentage of the oil from the exhaust air. This is of particular importance, since the ram boring machines of the type in question are mostly employed for trenchless laying of supply pipes in areas that are heavily populated and/or where the traffic is heavy.

What is claimed is:

1. A ram boring machine for use in an underground body of soil and having an external diameter, said machine including an axially reciprocating piston driven by compressed air and imparting impact energy to the boring machine for producing a tunnel in the underground body of soil with the tunnel having a diameter corresponding to the external diameter of the boring machine and with the boring machine discharging exhaust air in the axial direction into the tunnel wherein the improvement comprises an axially extending hollow cylinder housing having a first end and a second end spaced apart in the axial direction and located in the flow of exhaust air in the tunnel from said boring machine, means forming an axially extending cylindrical passage for conveying compressed air therethrough located within and spaced inwardly from said housing and extending axially between the first and second ends thereof, an annular passageway located between the housing and said means and extending axially between the first and second ends, an end face plate at each of said first and second ends of the annular passageway, exhaust air inlet holes in said end face plate at the first end and exhaust air outlet holes in said end face plate at the second end in general axial alignment for conveying the exhaust air axially through said annular passageway about said cylindrical passage, and at least one of a sound absorbing filter material and an oil separating filter material filling the annular passageway between the first and second ends.

2. A ram boring machine according to claim 1, wherein said cylindrical passage is concentric with the axis of said boring machine.

3. A ram boring machine according to claim 2, wherein said cylindrical passage projects outwardly from the first and second ends of said hollow cylinder housing, said cylindrical passage having opposite ends and being imperforate being said opposite ends.

4. A ram boring machine according to claim 1, where the hollow cylinder housing is arranged on a rear end of the machine.

5. A ram boring machine according to claim 1 wherein at least one of said first and second end face plates of the hollow cylinder housing is provided with a cable connection.

6. A ram boring machine according to claim 1, wherein the hollow cylinder housing is arranged to move in the tunnel made by the machine through the underground body of soil.

7. A ram boring machine according to claim 1, wherein the hollow cylinder housing is arranged in a pipe drawn behind the machine.

8. A ram boring machine according to claim 1, wherein an axially extending section of sound-absorbing filter material extends from the first end to intermediate the first and second ends, and an axially extending section of oil separating filter material extends from the sound-absorbing filter material to the second end.

* * * * *